US009255317B2

(12) United States Patent
Morton

(10) Patent No.: US 9,255,317 B2
(45) Date of Patent: Feb. 9, 2016

(54) METHOD OF COLD FORMING TITANIUM ALLOY SHEET METAL

(75) Inventor: Antony John Morton, Nottingham (GB)

(73) Assignee: ROLLS-ROYCE plc, London (GB)

( * ) Notice: Subject to any disclaimer, the term of this patent is extended or adjusted under 35 U.S.C. 154(b) by 761 days.

(21) Appl. No.: 13/552,094

(22) Filed: Jul. 18, 2012

(65) Prior Publication Data

US 2013/0019998 A1 Jan. 24, 2013

(30) Foreign Application Priority Data

Jul. 21, 2011 (GB) ..... 1112514.3

(51) Int. Cl.
*C22F 1/18* (2006.01)
*C22C 14/00* (2006.01)

(52) U.S. Cl.
CPC ..... *C22F 1/183* (2013.01)

(58) Field of Classification Search
CPC ..... C22F 1/183; C22C 14/00
USPC ..... 148/537, 670, 566
See application file for complete search history.

(56) References Cited

U.S. PATENT DOCUMENTS 3,180,764 A 4/1965 Timmins et al.
3,276,239 A * 10/1966 Achler et al. ..... 72/57
3,492,172 A * 1/1970 Partridge et al. ..... 148/670
5,141,565 A 8/1992 Kramer et al.
5,178,694 A 1/1993 Wu et al.
5,509,979 A * 4/1996 Kimura ..... 148/421

FOREIGN PATENT DOCUMENTS

EP 1 598 438 A1 11/2005
FR 2 696 957 A1 4/1994

OTHER PUBLICATIONS

Joseph Beal, et al, "Forming of Titanium and Titanim Alloys", 2006, ASM Handbook vol. 14B, pp. 656-669.*
Beal, Joseph D., "Forming of Titanium and Titanium Alloys," ASM Handbook, 2006, vol. 14B, pp. 656-669.
Search Report issued in British Patent Application No. GB1112514.3 dated Aug. 23, 2011.

* cited by examiner

*Primary Examiner* — Jessee Roe
(74) *Attorney, Agent, or Firm* — Oliff PLC

(57) ABSTRACT

A method of cold forming titanium alloy sheet metal, the titanium alloy consisting of 5.5 to 6.75 wt % aluminum, 3.5 to 4.5 wt % vanadium and the balance titanium plus incidental impurities, the method comprising the steps of (a) heat treating at 700° C. for at least 30 minutes and (b) cold forming at room temperature. Step (b) may comprise bending the titanium alloy sheet metal using a press brake. Step (b) may comprise placing a neoprene rubber film or a rubber film between the titanium alloy sheet metal and a lower V of the press brake. Step (b) may comprise placing the titanium alloy sheet metal into the press brake such that the grain of the titanium alloy sheet metal is arranged at an angle to the bend axis of the press brake. The method reduces and preferably overcomes cracking of the titanium alloy sheet metal during cold forming.

20 Claims, 1 Drawing Sheet

METHOD OF COLD FORMING TITANIUM ALLOY SHEET METAL

The present invention relates to a method of cold forming titanium alloy sheet metal and in particular to a method of cold forming titanium alloy sheet metal consisting of 5.5 to 6.75 wt % aluminium, 3.5 to 4.5 wt % vanadium and the balance titanium plus incidental impurities.

BACKGROUND OF THE INVENTION

There are problems associated with the cold forming, for example bending using a press brake, of titanium alloy sheet metal, Ti64, consisting 5.5 to 6.75 wt % aluminium, 3.5 to 4.5 wt % vanadium and the balance titanium plus incidental impurities. Ti64 has poor cold formability and the problem is one of cracking due to the slightest surface defect, even when caused by an appropriate method of handling or appropriately polished press brake tooling. Therefore, the use of Ti64 as a cold-formed sheet metal is fraught with difficulties and is liable to create components which require laboratory investigations after manufacture in order to gain confidence that there are non cracks or any other type of defect present. Such laboratory investigations extend the lead-time of the component and add considerable cost to the manufacturing process.

Due to the problem associated with cold forming of titanium alloy sheet metal consisting 5.5 to 6.75 wt % aluminium, 3.5 to 4.5 wt % vanadium and the balance titanium plus incidental impurities it has recently been common practice to use a titanium alloy sheet metal, AMS 4914, consisting 15 wt % vanadium, 3 wt % chromium, 3 wt % aluminium, 3 wt % tin and the balance titanium plus incidental impurities. AMS 4914 has good cold formability and may be heat treated after cold forming.

However, AMS 4914 is more expensive than Ti64. In addition, the heat treatment required for AMS 4914 titanium alloy sheet metal is of 8 hours duration at approximately 450° C. During this heat treatment the "stressed" formed titanium alloy sheet metal component is liable to further distortion, due to stress relaxation, which may have to be corrected after the heat treatment and thus incur further costs.

SUMMARY OF THE INVENTION

Accordingly the present invention seeks to provide a method of cold forming titanium alloy sheet metal which reduces, preferably overcomes, the above mentioned problems.

Accordingly the present invention provides a method of cold forming titanium alloy sheet metal, the titanium alloy consisting of 5.5 to 6.75 wt % aluminium, 3.5 to 4.5 wt % vanadium and the balance titanium plus incidental impurities, the method comprising the steps of (a) heat treating the titanium alloy sheet metal at at least 700° C. for at least 30 minutes and (b) cold forming the heat treated titanium alloy sheet metal at room temperature.

The titanium alloy sheet metal may have a thickness less than 2.6 mm.

Step (b) may comprise bending the titanium alloy sheet metal. Step (b) may comprise arranging the titanium alloy sheet metal with the grain of the titanium alloy sheet metal at an angle to a bend axis and bending the titanium alloy sheet metal about the bend axis. Step (b) may comprise bending the titanium alloy sheet metal using a press brake. Step (b) may comprise placing a film of resilient material between the titanium alloy sheet metal and a lower V of the press brake. The film of resilient material may be a neoprene rubber film or a rubber film. Step (b) may comprise placing the titanium alloy sheet metal into the press brake such that the grain of the titanium alloy sheet metal is arranged at an angle to the bend axis of the press brake.

Step (a) may comprise applying a coating to prevent the formation of an oxide to both surfaces of the titanium alloy sheet metal before heat treating, heat treating at at least 700° C. for at least 30 minutes, vapour blasting both surfaces of the titanium alloy sheet metal to remove at least 6 microns and flash etching to remove 20 to 25 microns from both surfaces of the titanium alloy sheet.

The method may comprise cutting the titanium alloy sheet metal to form a component after step (a) and before step (b). Alternatively the method may comprise cutting the titanium alloy sheet metal to form a component before step (a).

The cutting of the titanium alloy sheet metal may comprise laser cutting or other suitable cutting technique.

The method may comprise de-burring after step (b).

The component may be a bracket, a bulkhead or a fairing. The component may be a component of a gas turbine engine or a component of an aircraft.

BRIEF DESCRIPTION OF THE SEVERAL VIEW OF THE DRAWINGS

The present invention will be more fully described by way of example with reference to the accompanying drawings, in which.

DETAILED DESCRIPTION OF THE INVENTION

Figure 1:
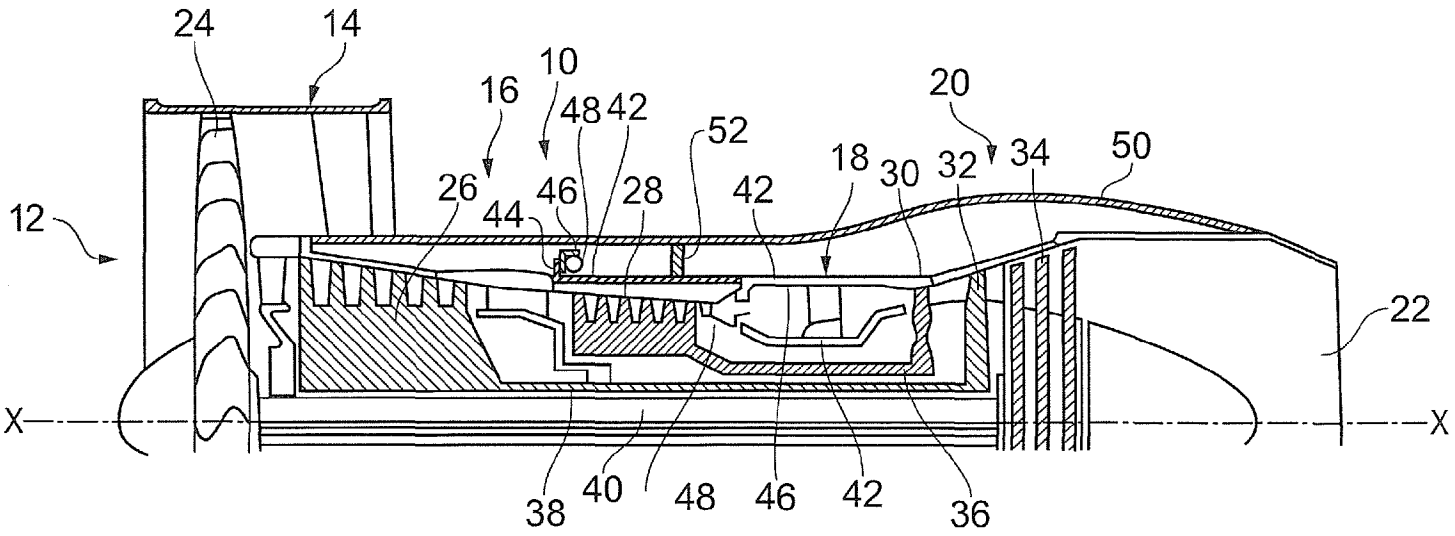
FIG. 1 is a longitudinal cut away view of a turbofan gas turbine engine having a component produced using a method of cold forming titanium alloy sheet metal according to the present invention.

A turbofan gas turbine engine 10, as shown in FIG. 1, comprises in flow series an inlet 12, a fan section 14, a compressor section 16, a combustion section 18, a turbine section 20 and an exhaust 22. The fan section 14 comprises a fan 24. The compressor section 16 comprises in flow series an intermediate pressure compressor 26 and a high pressure compressor 28. The turbine section 20 comprises in flow series a high pressure turbine 30, an intermediate pressure turbine 32 and a low pressure turbine 34. The fan 24 is driven by the low pressure turbine 34 via a shaft 40. The intermediate pressure compressor 26 is driven by the intermediate pressure turbine 32 via a shaft 38 and the high pressure compressor 28 is driven by the high pressure turbine 30 via a shaft 36. The turbofan gas turbine engine 10 operates quite conventionally and its operation will not be discussed further. The turbofan gas turbine engine 10 has a rotational axis X.

Figure 2:
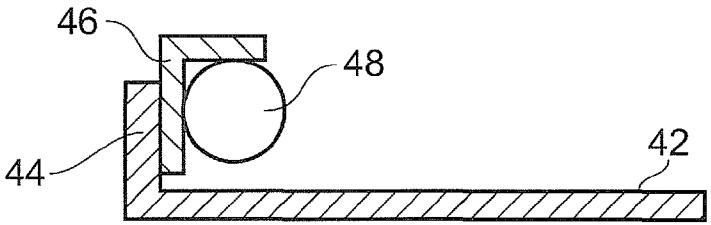
FIG. 2 is an enlarged cross-sectional view of a component produced using a method of cold forming titanium alloy sheet metal according to the present invention.

The turbofan gas turbine engine 10 has one or more casings 42 and one or more brackets 46 are secured to flanges 44 of the casings 42 to secure various cables, pipes 48 etc to the turbofan gas turbine engine 10, as shown more clearly in FIG. 2. Similarly the turbofan gas turbine engine 10 has a fairing 50 and a bulkhead 52, as shown in FIG. 1. The brackets 46 and fairing 50 and bulkhead 52 consist of a titanium alloy consisting of 5.5 to 6.75 wt % aluminium, 3.5 to 4.5 wt % vanadium and the balance titanium plus incidental impurities and the brackets 46 and fairing 50 and bulkhead 52 are cold formed from titanium alloy sheet metal using a method according to the present invention.

A method of cold forming the titanium alloy sheet metal, the titanium alloy consisting of 5.5 to 6.75 wt % aluminium, 3.5 to 4.5 wt % vanadium and the balance titanium plus incidental impurities, the method comprising the steps of (a) heat treating the titanium alloy sheet metal at at least 700° C. for at least 30 minutes and (b) cold forming the heat treated titanium alloy sheet metal at room temperature. The heat treatment may be at a suitable temperature up to 900° C.

In an example the titanium alloy sheet metal has a thickness less than 2.6 mm, the cold forming of the titanium alloy sheet metal comprises bending the titanium alloy sheet metal. The bending of the titanium alloy sheet metal comprises arranging the titanium alloy sheet metal with the grain of the titanium alloy sheet metal at an angle to a bend axis and bending the titanium alloy sheet metal about the bend axis.

In a particular example the bending of the titanium alloy sheet metal involve using a press brake. The cold formability of the titanium alloy sheet metal may be improved to enable minimum internal bend radii of 5× thickness of the titanium alloy sheet metal to be produced by storing each heat treated titanium alloy sheet metal on a flat wooden pallet, lifting the heat treated titanium alloy sheet metal carefully onto a flatbed laser cutting machine using appropriate equipment. The bending of the titanium alloy sheet metal comprises placing a film of resilient material between the titanium alloy sheet metal and a lower V of the press brake. The film of resilient material may be a neoprene rubber film or a rubber film. The bending of the titanium alloy sheet metal comprise placing the titanium alloy sheet metal into the press brake such that the grain of the titanium alloy sheet metal is arranged at an angle to the bend axis of the press brake.

The heat treating of the titanium alloy sheet metal comprises degreasing the surfaces of the titanium alloy sheet metal, applying a coating to prevent the formation of an oxide to the surfaces of the titanium alloy sheet metal before heat treating, heat treating at at least 700° C. for at least 30 minutes, abrasive blasting the surfaces of the titanium alloy sheet metal to remove at least 6 microns and etching to remove 20 to 25 microns from the surfaces of the titanium alloy sheet. The degreasing involves using a hot liquid solvent or vapour solvent. The coating to prevent the formation of an oxide may be a Berkatekt® coating for example Berkatekt 12, or Berkatekt 22, and the coating may be applied by spraying or dipping. The heat treatment may be in an air furnace. The coating to prevent the formation of an oxide is removed from the titanium alloy sheet metal after heat treatment by abrasive blasting, wet abrasive blasting e.g. vapour blasting using a non metallic abrasive suspended in water in which the abrasive is delivered to the gun by a compressed air/venture system. The surface of the titanium alloy sheet metal is then etched in a solution of hydrofluoric acid (HF) and ferric sulphate ($Fe2(SO_4)_3$). The titanium alloy sheet is then washed with water e.g. using a high pressure water wash.

The method may comprise cutting the titanium alloy sheet metal to form a component after the heat treatment of the titanium alloy sheet metal and before the cold forming of the titanium alloy sheet metal. Alternatively the method may comprise cutting the titanium alloy sheet metal to form a component before the heat treatment of the titanium alloy sheet metal. The cutting of the titanium alloy sheet metal may comprise laser cutting or other suitable cutting technique. The method may comprise de-burring after cold forming of the titanium alloy sheet metal.

The component may be a bracket 44, a bulkhead 48 or a fairing 50. The component may be a component of any type of gas turbine engine 10 or a component of an aircraft.

In a particular example the titanium alloy sheet metal was heat treated at 700° C. for 30 minutes and then the heat treated titanium alloy sheet metal was cold formed.

The advantage of the present invention is that it effectively eliminates the non-controllable defects in this titanium alloy sheet metal caused during the manufacture of the titanium alloy sheet metal at the manufacturing mill, transportation of the titanium alloy sheet metal and general handling of the titanium alloy sheet metal before cold forming.

Thus, according to the present invention the titanium alloy sheet is heat treated before the titanium alloy sheet is cold formed. It may be possible to provide a further heat treatment after the titanium alloy sheet has been cold formed for stress relief or stress reduction. The further heat treatment may be identical to the heat treatment before cold forming, e.g. at a temperature of at least 700° C. for at least 30 minutes.

The invention claimed is:

1. A method of cold forming titanium alloy sheet metal, the titanium alloy consisting of 5.5 to 6.75 wt % aluminum, 3.5 to 4.5 wt % vanadium and the balance titanium plus incidental impurities, the method comprising the sequential steps of (a) applying a coating to prevent the formation of an oxide to both surfaces of the titanium alloy sheet metal before heat treating, (b) heat treating the titanium alloy sheet metal at at least 700° C. for at least 30 minutes, (c) abrasive blasting both surfaces of the titanium alloy sheet metal to remove at least 6 microns, (d) etching to remove 20 to 25 microns from both surfaces of the titanium alloy sheet metal, and (e) cold forming the heat treated titanium alloy sheet metal at room temperature.

2. A method as claimed in claim 1 wherein the titanium alloy sheet metal having a thickness less than 2.6 mm.

3. A method as claimed in claim 1 wherein step (b) comprises bending the titanium alloy sheet metal.

4. A method as claimed in claim 3 wherein step (b) comprises arranging the titanium alloy sheet metal with the grain of the titanium alloy sheet metal at an angle to a bend axis and bending the titanium alloy sheet metal about the bend axis.

5. A method as claimed in claim 3 wherein step (b) comprises bending the titanium alloy sheet metal using a press brake.

6. A method as claimed in claim 5 wherein the press brake has a lower V, step (b) comprises placing a film of resilient material between the titanium alloy sheet metal and the lower V of the press brake.

7. A method as claimed in claim 5 wherein the press brake has a bend axis, step (b) comprises placing the titanium alloy sheet metal into the press brake such that the grain of the titanium alloy sheet metal is arranged at an angle to the bend axis of the press brake.

8. A method as claimed in claim 1 comprising cutting the titanium alloy sheet metal to form a component after step (a) and before step (b).

9. A method as claimed in claim 8 wherein the cutting comprises laser cutting.

10. A method as claimed in claim 1 comprising de-burring after step (b).

11. A method as claimed in claim 8 wherein the component is selected from the group consisting of a bracket, a bulkhead and a fairing.

12. A method as claimed in claim 8 wherein the component is a component of a gas turbine engine or a component of an aircraft.

13. A method as claimed in claim 1 comprising cutting the titanium alloy sheet metal to form a component before step (a).

14. A method as claimed in claim 13 wherein the cutting comprises laser cutting.

15. A method as claimed in claim 13 wherein the component is selected from the group consisting of a bracket, a bulkhead and a fairing.

16. A method as claimed in claim 13 wherein the component is a component of a gas turbine engine or a component of an aircraft.

17. A method as claimed in claim 1 further comprising after step (e) an additional step (f) of heat treating the titanium alloy sheet metal at at least 700° C. for at least 30 minutes for stress relief of the cold formed heat treated titanium alloy sheet metal.

18. A method of cold forming titanium alloy sheet metal, the titanium alloy consisting of 5.5 to 6.75 wt % aluminum, 3.5 to 4.5 wt % vanadium and the balance titanium plus incidental impurities, the method comprising the sequential steps of (a) applying a coating to prevent the formation of an oxide to both surfaces of the titanium alloy sheet metal before heat treating, (b) heat treating the titanium alloy sheet metal at at least 700° C. for at least 30 minutes, (c) abrasive blasting both surfaces of the titanium alloy sheet metal to remove at least 6 microns, (d) etching to remove 20 to 25 microns from both surfaces of the titanium alloy sheet metal, and (e) cold forming the heat treated titanium alloy sheet metal at room temperature, wherein the heat treated titanium alloy sheet metal is at room temperature during the cold forming.

19. A method as claimed in claim 18 comprising storing the heat treated titanium alloy sheet metal after step (d) and before step (e).

20. A method of cold forming titanium alloy sheet metal, the titanium alloy consisting of 5.5 to 6.75 wt % aluminum, 3.5 to 4.5 wt % vanadium and the balance titanium plus incidental impurities, the method comprising the sequential steps of (a) applying a coating to prevent the formation of an oxide to both surfaces of the titanium alloy sheet metal before heat treating, (b) heat treating the titanium alloy sheet metal at 700° C. for at least 30 minutes, (c) abrasive blasting both surfaces of the titanium alloy sheet metal to remove at least 6 microns, (d) etching to remove 20 to 25 microns from both surfaces of the titanium alloy sheet metal, wherein steps (a), (b), (c) and (d) reduce non-controllable defects in the titanium alloy sheet metal produced during the manufacture of the titanium alloy sheet metal, transportation of the titanium alloy sheet metal or handling of the titanium alloy sheet metal, and (e) cold forming the heat treated titanium alloy sheet metal at room temperature.

* * * * *